US008339066B2

(12) United States Patent
Thornton et al.

(10) Patent No.: US 8,339,066 B2
(45) Date of Patent: Dec. 25, 2012

(54) ENERGY SAVING LIGHTING SYSTEMS AND UNITS PROVIDING COORDINATED OPERATION OF HOLDING CURRENT UNITS

(75) Inventors: Tom William Thornton, North Vancouver (CA); Milen Moussakov, New Westminster (CA); Gregory Bernard Sheehan, Delta (CA)

(73) Assignee: Light-Based Technologies Incorporated, Vancouver (CA)

( * ) Notice: Subject to any disclaimer, the term of this patent is extended or adjusted under 35 U.S.C. 154(b) by 0 days.

(21) Appl. No.: 13/072,638

(22) Filed: Mar. 25, 2011

(65) Prior Publication Data

US 2011/0266974 A1 Nov. 3, 2011

(30) Foreign Application Priority Data

Oct. 26, 2010 (WO) ..... PCT/CA2010/001677

(51) Int. Cl.
*H05B 37/02* (2006.01)

(52) U.S. Cl. ..... 315/291; 315/297; 315/308

(58) Field of Classification Search ..... 315/200 R, 315/291, 294, 297, 307, 308, 361; 363/54, 363/55, 89
See application file for complete search history.

(56) References Cited

U.S. PATENT DOCUMENTS

| | | | | |
|---|---|---|---|---|
| 5,652,481 | A | 7/1997 | Johnson et al. | |
| 5,955,847 | A | 9/1999 | Rothenbuhler | |
| 6,834,002 | B2 | 12/2004 | Yang | |
| 7,102,902 | B1 | 9/2006 | Brown et al. | |
| 7,696,698 | B2 | 4/2010 | Ghanem | |
| 7,902,769 | B2 | 3/2011 | Shteynberg et al. | |
| 7,978,485 | B2 * | 7/2011 | Stamm et al. | 363/44 |
| 2003/0197497 | A1 | 10/2003 | Barcelo et al. | |
| 2008/0258647 | A1 | 10/2008 | Scianni | |
| 2010/0090618 | A1 | 4/2010 | Veltman | |
| 2011/0068706 | A1 * | 3/2011 | Otake et al. | 315/291 |
| 2011/0084622 | A1 | 4/2011 | Barrow et al. | |
| 2011/0115395 | A1 | 5/2011 | Barrow et al. | |
| 2011/0121744 | A1 * | 5/2011 | Salvestrini et al. | 315/246 |
| 2011/0140620 | A1 * | 6/2011 | Lin et al. | 315/224 |

FOREIGN PATENT DOCUMENTS

| | | | |
|---|---|---|---|
| GB | 1146776 | A | 3/1969 |
| WO | 9945750 | A1 | 9/1999 |
| WO | 0101385 | A1 | 1/2001 |
| WO | 2005115058 | A1 | 12/2005 |
| WO | 2009101544 | A2 | 8/2009 |
| WO | 2010027254 | A1 | 3/2010 |

OTHER PUBLICATIONS

"LM3445 Off-Line TRIAC Dimmer LED Driver Demo Board", National Semiconductor Corporation, Application Note 1935, Apr. 14, 2009.

* cited by examiner

*Primary Examiner* — Jimmy Vu
(74) *Attorney, Agent, or Firm* — Oyen Wiggs Green & Mutala LLP

(57) ABSTRACT

Holding current circuits in light sources controlled by a dimmer are operated in a coordinated manner to maintain proper operation of the dimmer without wasting energy. A plurality of light sources each including a separate holding current circuit may be controlled by a dimmer. The holding current units are selectively disabled and/or a maximum holding current drawn by the holding current units are selectively adjusted to maintain a desired current draw.

16 Claims, 13 Drawing Sheets

ENERGY SAVING LIGHTING SYSTEMS AND UNITS PROVIDING COORDINATED OPERATION OF HOLDING CURRENT UNITS

FIELD OF THE INVENTION

This invention relates to lighting and has example application in architectural lighting. Some embodiments of the invention provide solid-state light sources configured to be controlled by phase-cut dimmers.

BACKGROUND

TRIACS are solid-state switches that find application inter alia in dimmers for use within architectural lighting circuits. A TRIAC requires a holding current to stay in conduction. Some solid-state lighting fixtures include holding current circuits which ensure that when the lighting fixture is being driven it will always draw a current that is at least equal to the holding current thus ensuring proper operation of a TRIAC dimmer connected to control the lighting fixture.

The inventors have identified the problem that holding current circuits can waste energy in cases where multiple light fixtures are controlled by a single dimmer. If each one of the light fixtures has a holding current circuit then the light fixtures will collectively draw significantly more current than is required for proper operation of a dimmer. For example, if N light fixtures all on a circuit driven by the same dimmer each have a holding current circuit then the holding current circuits will ensure that the current being drawn will always be at least N times the amount of current drawn by any one of the holding current units. This results in wasted energy. Although the amount of power drawn by a typical individual holding current unit is small, the amount of electrical power that could be saved by avoiding duplication of holding current is very significant since large numbers of light fixtures are all being driven.

There is a need for apparatus and methods that will assist in conserving energy.

There is a need for lighting systems that are more energy efficient.

SUMMARY

The invention has a number of aspects. These include without limitation: lighting systems which include multiple holding current circuits and control mechanisms for controlling the holding current circuits; lighting units that include holding current circuits and controls connected to enable or disable the holding current circuits; methods for operating lighting circuits that reduce power drawn by holding current circuits and/or other components.

One example aspect of the invention provides a lighting system that comprises a dimmer that requires at least a holding current to be drawn for proper operation. A plurality of light sources is connected in parallel to an output of the dimmer. Each of the light sources comprises: a light emitter; a holding current circuit operable to draw a current from the dimmer; and a control circuit connected to selectively control a current drawn by the holding current circuit. A control system is configured to automatically reduce an excess of the sum of the currents drawn by the holding current circuits over the holding current.

The control system in some embodiments comprises a central controller. In other embodiments the control system is provided by components distributed among the light sources. In other embodiments the control system combines a central controller with distributed control components. In an example embodiment the control system comprises a separate controller in data communication with the light sources and the separate controller is configured to command one or more of the light sources to disable its holding current circuit or to reduce the current drawn by its holding current circuit. In another example embodiment the control system comprises a path by way of which the control circuits of the light sources can exchange information and the control circuits are configured to disable the corresponding holding current circuits or reduce the current drawn by the corresponding holding current circuit in response to information received from other ones of the control circuits.

Another aspect of the invention provides a light source comprising a light emitter; a holding current circuit operable to draw a holding current up to an upper limiting current, and a control circuit connected to selectively control a value for the upper limiting current that the holding current circuit can draw.

Another aspect of the invention provides a light source comprising a light emitter, a holding current circuit operable to draw a holding current, and a control circuit connected to selectively enable or disable the holding current circuit. The control circuit comprises a manually operable switch in some embodiments. In some embodiments the light source comprises a signal input for receiving signals and the control circuit is configured to disable the holding current circuit upon receipt of a signal indicating that another light source is drawing a holding current.

Another aspect of the invention provides a method for operating a lighting system that comprises a dimmer that requires at least a holding current to be drawn for proper operation. The lighting system comprises a plurality of light sources connected in parallel to an output of the dimmer. Each of the plurality of light sources comprises a holding current circuit capable of drawing at least the holding current from the dimmer. The method comprises automatically controlling current drawn by the holding current circuits to reduce an excess of the sum of the currents drawn by the holding current circuits over the holding current.

Further aspects of the invention and features of non-limiting example embodiments are illustrated by the accompanying drawings and described in the following detailed description.

BRIEF DESCRIPTION OF DRAWINGS

Exemplary embodiments are illustrated in referenced figures of the drawings. The embodiments and figures disclosed herein are to be considered illustrative rather than restrictive.

DESCRIPTION

Throughout the following description specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense.

Figure 1:
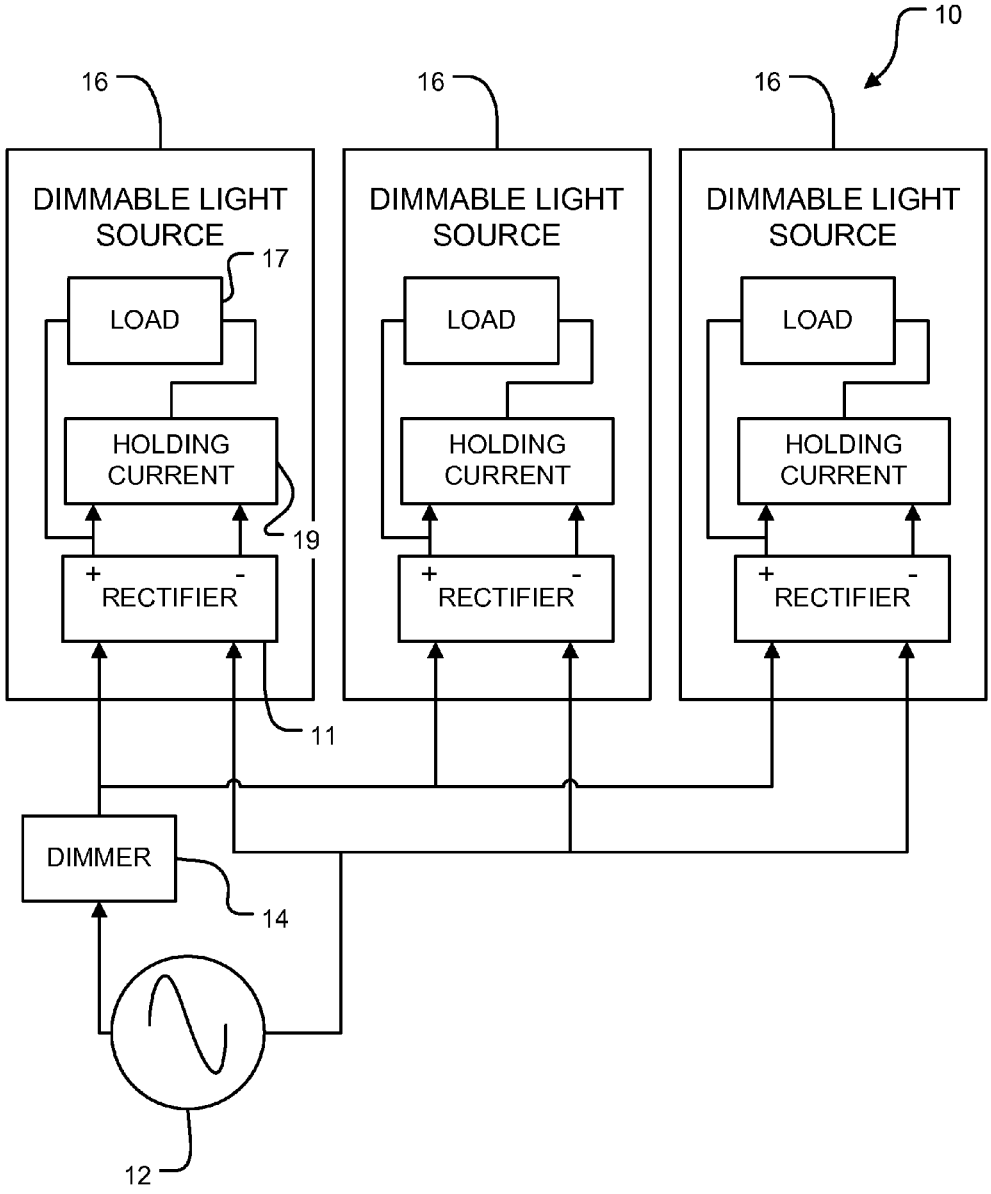
FIG. 1 is a block diagram of a lighting circuit having several dimmable light sources controlled by a single dimmer.

FIG. 1 shows a lighting circuit 10 which includes a number of dimmable light sources 16. Light sources 16 may, for example, comprise solid-state lighting units such as semiconductor light-emitting diodes (LEDs), organic light-emitting diodes (OLEDs), polymer light-emitting diodes (PLEDs) or the like. Although circuit 10 is illustrated as including three light sources 16, fewer or many more light sources 16 may be present in circuit 10. The precise number of light sources may vary from circuit-to-circuit. Circuit 10 is driven by AC power 12. A dimmer 14 of the type which requires a holding current to be drawn for proper operation is connected into the circuit. Light sources 16 are connected in parallel. Each light source 16 receives electrical power having a waveform modified by dimmer 14.

In the illustrated embodiment, each dimmable light source comprises a load (for example, one or more LED light emitters) 17. Electrical current is supplied to load 17 by way of a rectifier 11 and a holding current circuit 19. Holding current circuit 19 ensures that the light source 16 always draws at least enough current for the proper operation of dimmer 14. In some embodiments, holding current circuit 19 is of the type described in U.S. patent application Ser. No. 12/912,613 filed on 26 Oct. 2010 and entitled HIGH EFFICIENCY HOLDING CURRENT CIRCUIT FOR SOLID STATE LIGHTING APPLICATIONS which is hereby incorporated herein by reference.

Figure 2:
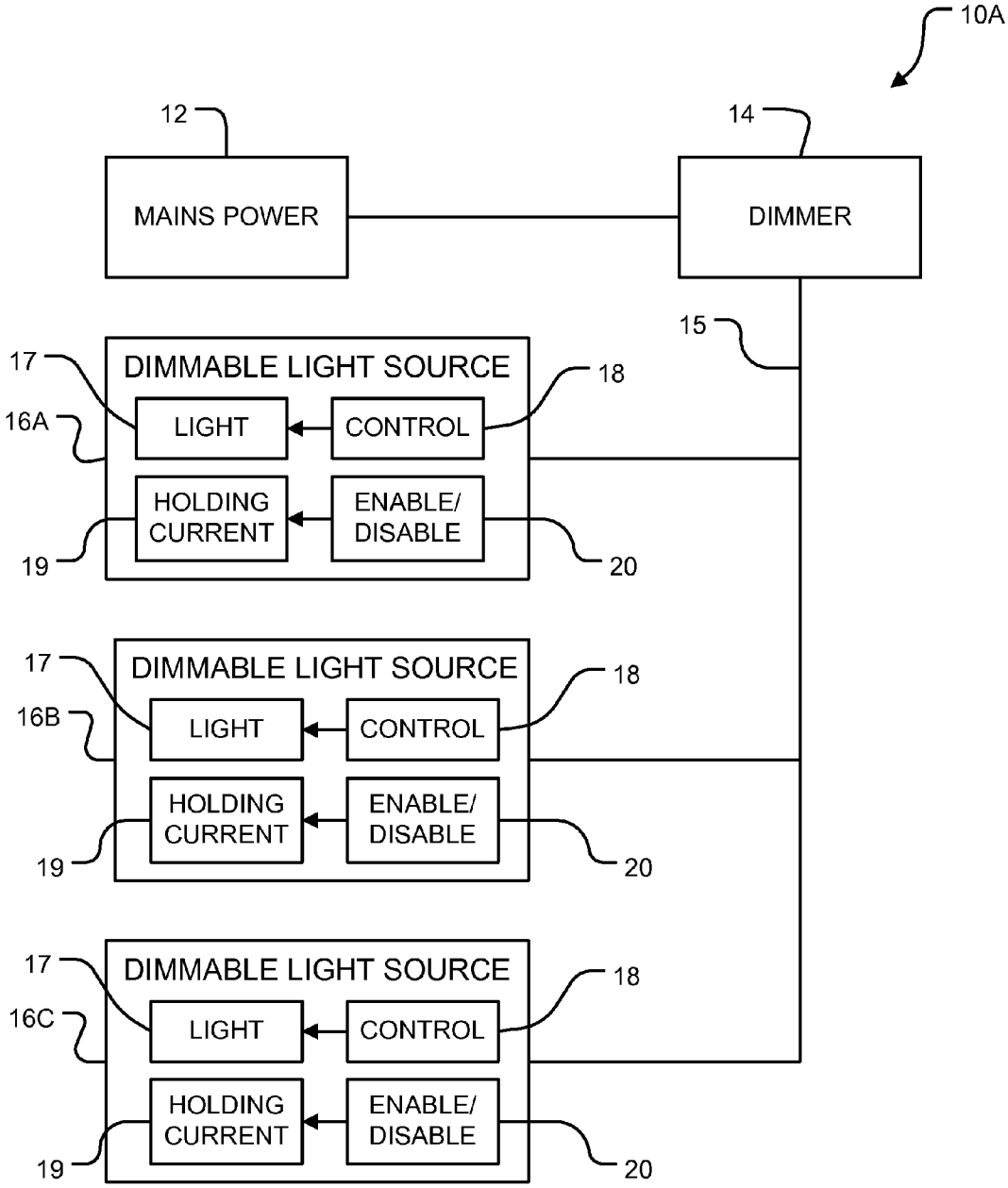
FIG. 2 is a block diagram of a light circuit according to an example embodiment of the invention in which holding current circuits in dimmable light sources can be enabled or disabled.

FIG. 2 illustrates a lighting circuit 10A having modified dimmable light sources 16A, 16B, 16C which can be operated so as to reduce or eliminate unnecessarily large current draw arising from the operation of multiple holding current circuits 19. Mains power 12 and dimmer 14 are as shown in FIG. 1. In circuit 10A, dimmable light sources comprise a lighting load 17 controlled by a control 18. Control 18 may, for example, determine a phase angle at which an AC power waveform is cut off by dimmer 14 and adjust the brightness of lighting load 17 based on that phase angle.

The light sources 16 also include a holding current circuit 19. An enable/disable circuit 20 controls the holding current circuit 19. When holding current circuit 19 is disabled, then it draws no current or significantly reduced current.

Circuit 10A may be operated so as to reduce the amount of current drawn by some or all of holding current circuits 19 in light sources 16A, 16B, 16C, etc. (collectively light sources 16) so as to reduce the aggregate current drawn by holding current circuits 19 while still ensuring that the connected light sources 16 draw, in aggregate, a current that is at least equal to the holding current required for proper operation of dimmer 14. Circuit 10A may comprise any number of light sources 16 up to a maximum number that can be driven by dimmer 14. Light sources 16 are connected to draw current from dimmer 14 in parallel. Since light sources 16 may be much more electrically efficient than conventional light sources such as incandescent bulbs or CCFL bulbs, many light sources 16 may be powered by a dimmer 14 while still providing substantial energy saving.

Figure 2A:
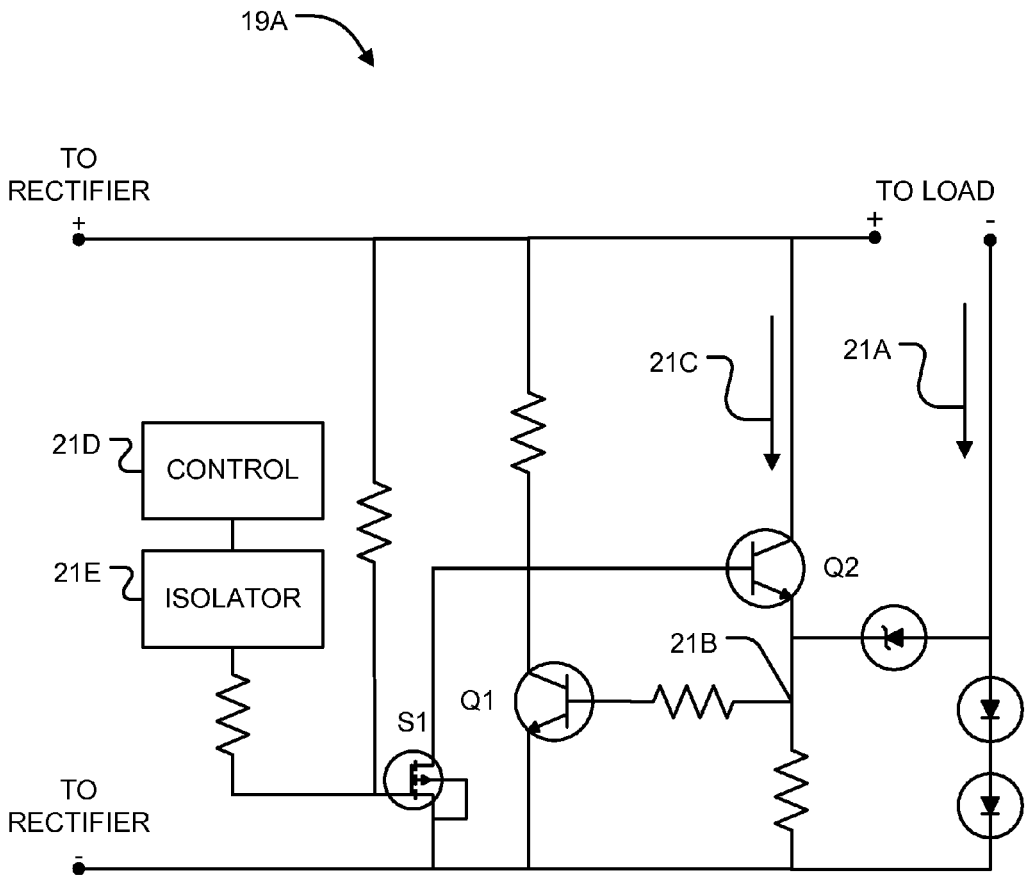
FIG. 2A is a schematic diagram illustrating an example holding current circuit that has an input for receiving an enable/disable signal.

FIG. 2A shows an example holding current circuit 19A that can be enabled or disabled by way of a control signal from another circuit. When holding current circuit 19A is enabled then it draws current by way of Q2, as needed. When current 21A through a load (not shown in FIG. 2A) is sufficiently large then the voltage at point 21B is sufficient to turn Q1 on, thereby pulling down the base of Q2 so that Q2 does not conduct. However, if current through the load drops below a threshold value then Q1 begins to turn off, thereby allowing Q2 to conduct. Component values may be selected such that the sum of the current 21C drawn by Q2 and current 21A drawn by the load is equal to the required holding current.

Holding current circuit 19A can be disabled when a signal received from a control 21D by way of isolator 21E turns FET S1 ON. This pulls down the base of Q1 so that Q2 does not conduct regardless of the voltage at point 21B, thereby disabling holding current circuit 19A.

Figure 2B:
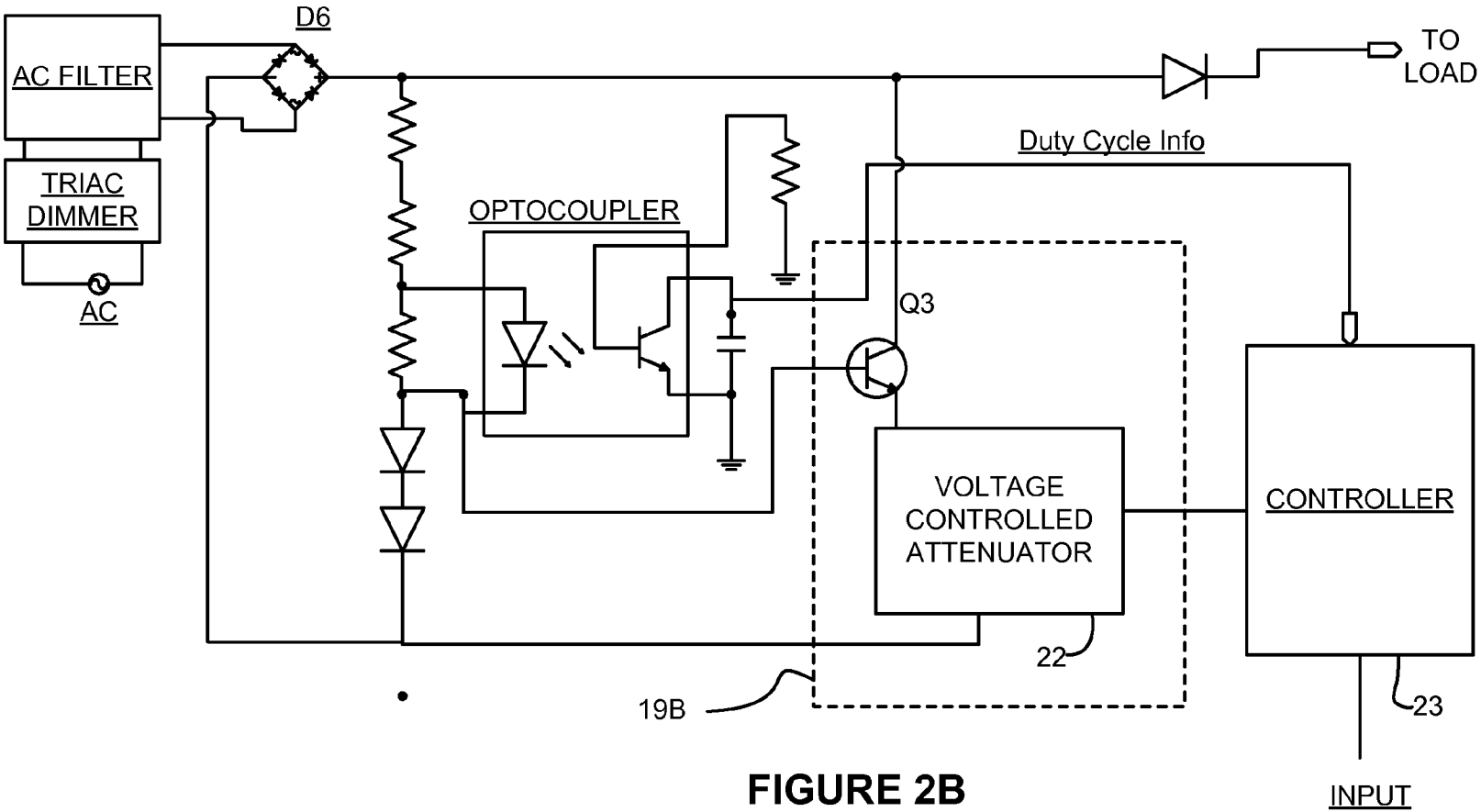
FIG. 2B is a schematic diagram illustrating another example holding current circuit that has an input for receiving a signal that sets a maximum holding current draw.

FIG. 2B shows another example holding current circuit 19B. Circuit 19B comprises a variable attenuator 22. The impedance of variable attenuator 22, which determines the maximum current that can be drawn by holding current circuit 19B (e.g. an upper limiting current for the holding current circuit), is controlled by a controller 23. Holding current circuit 19B draws current when Q3 conducts. Holding current circuit 19B may be disabled by setting variable attenuator 22 to an open circuit or other high-impedance condition. In a very simple embodiment, variable attenuator 22 is replaced by a switch controlled by controller 23 and a fixed resistor. In another alternative embodiment, Q3 is not present and controller 23 varies the attenuation provided by variable attenuator 22 to cause holding circuit 19B to draw a dynamically variable current. Variable attenuator 22 may be controlled so that a total current drawn by holding current circuit 19B and one or more loads is at least equal to the holding current required by a dimmer.

Different embodiments may provide different modes of operation. In some modes of operation, enable/disable units (e.g. enable/disable units 20 shown in FIG. 2) are operated so as to disable holding current circuits 19 in some but not all of the light sources. In some embodiments, a control method is performed which disables holding current circuits 19 in all but one of the light sources that are connected to dimmer 14. In other embodiments, enable/disable circuits 20 are operated to reduce the holding current drawn by some or all of holding current circuits 19 so as to reduce the aggregate amount of current drawn by the light sources 16 of circuit 10A while still causing the light sources 16 to draw aggregate current sufficient for the proper operation of dimmer 14 (i.e. aggregate current at least equal to the holding current).

Figure 3:
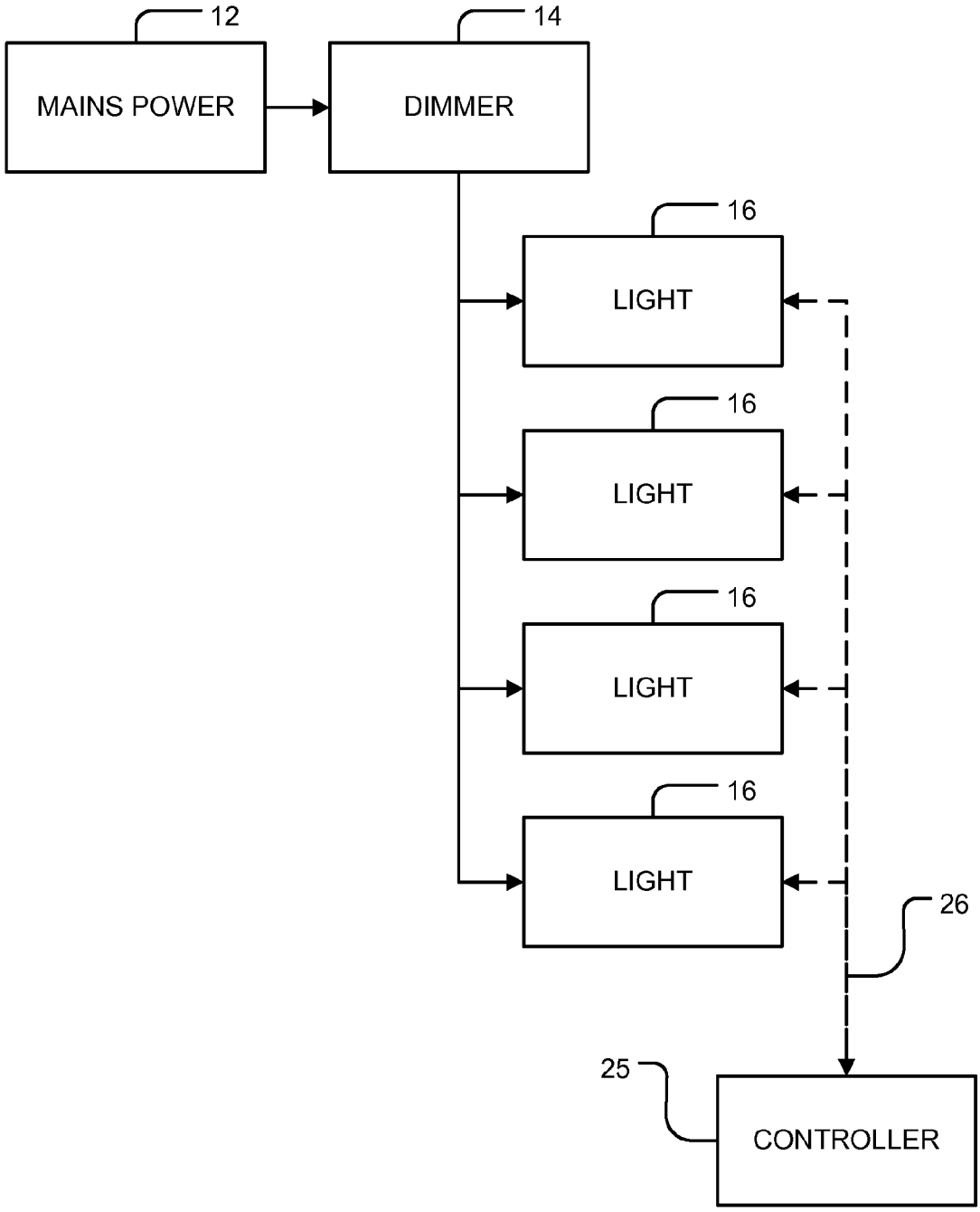
FIG. 3 is a block diagram of another example embodiment of the invention in which a controller is connected to control holding current circuits in a plurality of light sources.

A large number of different systems may be provided to control holding current circuits 19 in different light sources 16. In some embodiments, light sources 16 are configured to control holding current circuits based at least in part on external signals. Two examples are provided in FIGS. 3 and 4. FIG. 3 shows one example in which a controller 25 is connected to receive information from each light source 16 and to provide information to light sources 16 by way of a data path 26. Data path 26 may, for example, comprise a wire, an optical cable, an optical link, a wireless link, a data communication protocol carried over power wires, or the like. Data path 26 may be point-to-point, point-to-multipoint or a combination thereof.

In the embodiment of FIG. 3, each light source receives signals from controller 25 according to an agreed protocol. Controller 25 determines whether or not the holding current circuit in each light source should be enabled or disabled and communicates a signal to each light source which results in the holding current circuit of that light source being enabled or disabled, as appropriate. In some alternative embodiments, controller 25 may cause the task of maintaining an aggregate current draw at least equal to the holding current to be shared among different light sources. For example, the holding current circuits in each of light sources 16 may be controllable to vary the amount of current being drawn (either continuously or in steps) and/or the maximum current to be drawn (either continuously or in steps) and the signal from controller 25 may cause each light source 16 to set its holding current circuit to draw current such that, in aggregate, sufficient current is being drawn for the proper operation of dimmer 14 while making the total current drawn by the holding current circuits no greater than necessary.

In some embodiments controller 25 and light sources 16 may be configured such that light sources 16 communicate information regarding their status to controller 25 and controller 25 generates control signals for holding current circuits 19 based at least in part on information received from light sources 16. Controller 25 may provide other functions in addition. For example, controller 25 may control light sources 16 to change brightness and/or colour and/or turn on or off in a coordinated fashion to achieve desired lighting effects.

Figure 4:
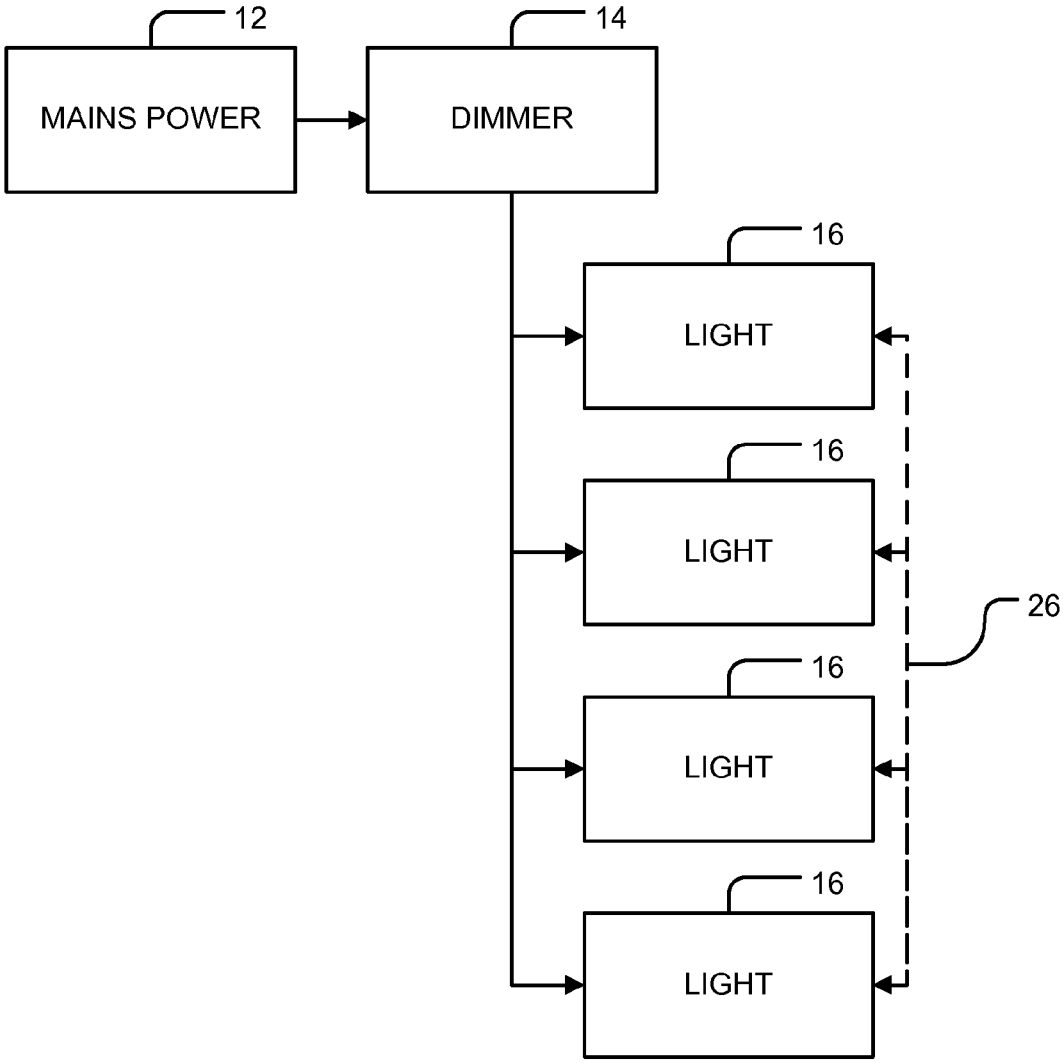
FIG. 4 is a block diagram of a lighting circuit according to another example embodiment in which light sources communicate in a peer-to-peer manner.

FIG. 4 shows an alternative embodiment in which controllers built into light sources 16 cooperate together to control holding current circuits in the light sources 16. The controllers in different light sources 16 communicate with one another by way of a suitable data path 26.

Figure 4A:
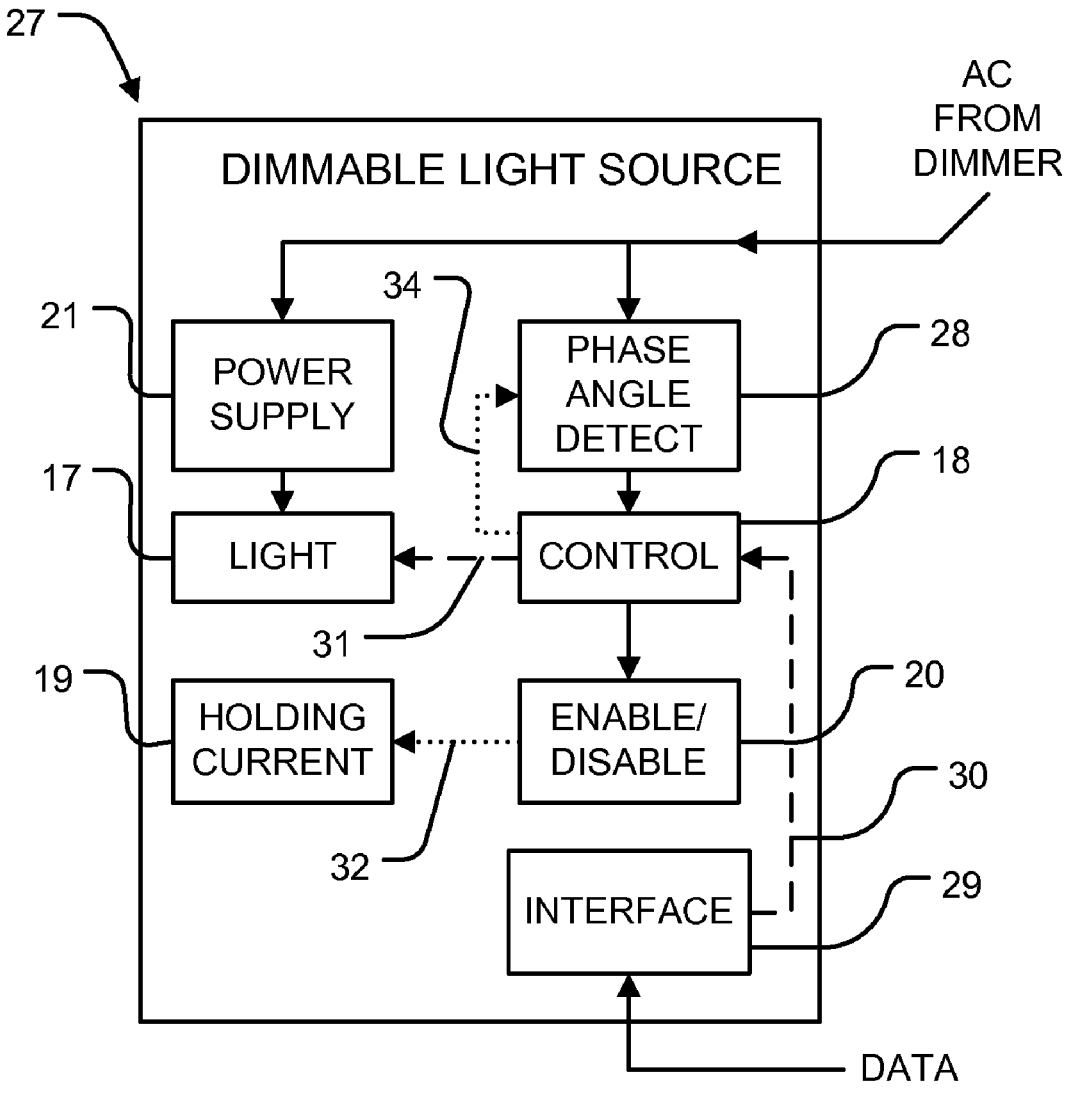
FIG. 4A is a block diagram showing a dimmable light source according to another example embodiment.

FIG. 4A provides a more detailed view of a dimmable light source 27 of a type which could be used in the circuits of FIG. 3 or 4. Dimmable light source 27 has a lighting load 17 controlled by a control 18. AC power from a dimmer powers lighting load 17 by way of a power supply 21. A phase angle detector 28 derives a signal from a phase at which the wave form from the dimmer is cut and supplies that signal to control 18. The signal represents an intended dimming level. Control 18 generates a control signal 31 for lighting load 17 based on the phase angle detected by phase angle detector 28. Control signal 31, may, for example, control the brightness of light emitted by lighting load 17 (or some other attribute of the light) based upon control signal 31.

Light source 27 also includes an interface 29 which receives data from other light sources 27 and/or from a controller (such as controller 25 of FIG. 3). In the illustrated embodiment, a signal 30 received at interface 29 is provided to control 18. In response to signal 30, control 18 may operate enable/disable circuit 20 to enable or disable the operation of holding current circuit 19. In the illustrated embodiment, a signal 32 controls the holding current circuit 19.

Referring again to FIGS. 3 and 4, in embodiments where light sources 16 are communicatively coupled to one another and/or to a controller 25 via data path 26, the operation of holding current circuits 19 (as shown, for example, in FIG. 4A) may be coordinated to maintain an aggregate current draw of at least a desired holding current in dimmer 14. For example, a light source 16 may be configured to receive signals indicative of current drawn by holding current circuits associated with the other light sources and to control based at least in part on these received signals whether or not its own holding current circuit draws any additional current from dimmer 14 and/or to control an amount of additional current drawn by its own holding current circuit.

A wide variety of methods may be used for controlling the operation of light sources which include holding current circuits as described above. For example, in embodiments where light sources 16 comprise coordination controllers that are communicatively coupled via a data path 26, the coordination controllers may be configured to coordinate maintenance of a current draw at least equal to a holding current in dimmer 14. For example, a coordination controller of at least one light source 16 may be configured to cause its associated holding current circuit to draw sufficient current for proper operation of dimmer 14, and be configured to communicate a disable signal to a coordination controller of at least one other light source that also draws current supplied by dimmer 14. The coordination controller of the at least one other light source may be configured to cause its associated holding current circuit to not draw current from dimmer 14 in response to the disable signal.

As another example, a coordination controller associated with each of a plurality of light sources 16 that draw current from a dimmer 14 may be configured to: communicate its existence to coordination controllers associated with other ones of the plurality of light sources; determine, based on communications from coordination controllers of the other light sources indicating the existence of the other light sources, a number N of the plurality of light sources; and configure its associated holding current circuit so that the light source maintains a current of at least 1/N of the holding current.

Figure 5:
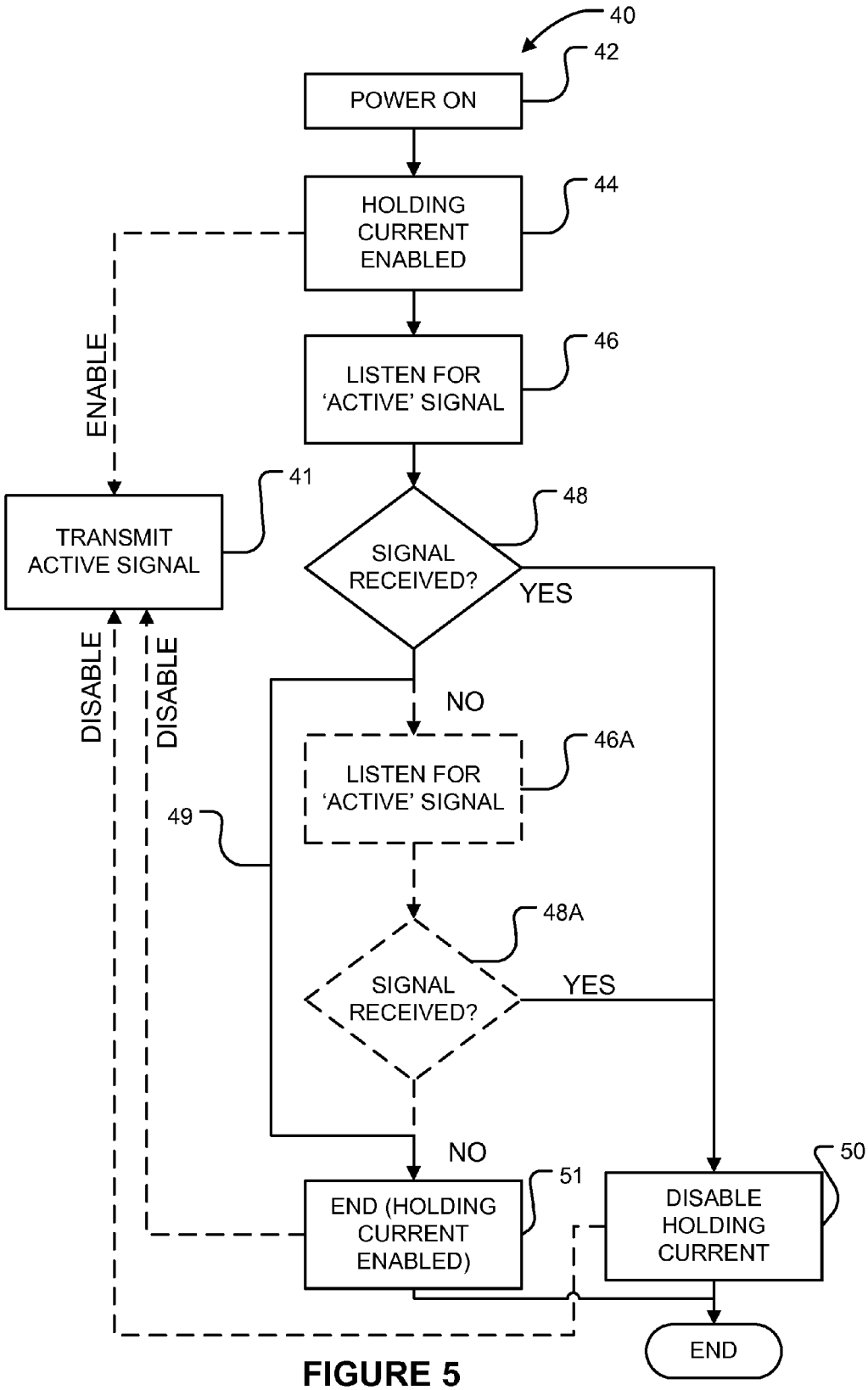
FIGS. 5 and 5A illustrate methods for controlling holding current circuits according to example embodiments.

FIG. 5 illustrates a method 40 according to an example embodiment. Method 40 may be performed independently by each light source. The light sources may, for example, comprise logic circuits or programmed data processors executing firmware or software instructions that execute method 40 when power is first applied to the light sources and/or when an initiation signal is received by the light sources.

Upon power being applied at block 42, a holding current circuit is enabled at block 44. While the holding current circuit in a light source is enabled, the light source transmits an "ACTIVE" signal as indicated by block 41. The ACTIVE signal may be sent periodically. The ACTIVE signal can be received by other light sources. Block 41 may be performed asynchronously of the rest of method 40, as illustrated or, in the alternative, may be performed at specific points in the processing of method 40.

At block 46, each light source listens for an "ACTIVE" signal from other light sources. The ACTIVE signal indicates that another light source also has an enabled holding current circuit. In some embodiments the transmission of ACTIVE signals by block 41 is inhibited during the listening of block 46.

Block 46 is performed at different times for different light sources (e.g. light sources 16 of FIG. 2). In some embodiments, block 46 is performed by each light source at a random time after power on. This makes it unlikely that any two light sources will both be performing block 46 at overlapping times. Where ACTIVE signals are sent periodically, block 46 may listen for ACTIVE signals long enough to detect ACTIVE signals from any other light source that has an enabled holding current circuit and is transmitting ACTIVE signals.

In block 48, it is determined whether an ACTIVE signal has been received. If block 48 determines that an ACTIVE signal has been received then, at block 50, the holding current circuit is disabled and method 40 terminates.

If block 48 determines that no ACTIVE signal was detected in block 46 then the holding current circuit remains enabled and method 40 terminates.

Method 40 implements a "last man standing" algorithm which will result in only one holding current circuit remaining active while holding current circuits in other light sources connected to the same dimmer are disabled.

To understand the operation of the "last man standing" algorithm, consider the case where a plurality of light sources (for example light sources 16A, 16B and 16C of FIG. 2) each perform a method like method 40 for controlling a holding current circuit 19 and are all connected to the same dimmer 14. In some embodiments, the combined effect is as follows: when circuit 10A is initially turned on, all of holding current circuits 19 are active. Each of light sources 16A, 16B and 16C is configured to periodically transmit an ACTIVE signal that is received by the other ones of light sources 16A, 16B and 16C.

For example, the ACTIVE signal may comprise a signal imposed on power line 15 (such as, for example a high frequency spike). The ACTIVE signals indicate the active state of the associated holding current circuit. The ACTIVE signals issued by light sources 16 may be identical. It is not mandatory that ACTIVE signals from different light sources 16 are distinguishable from one another.

Each of light sources 16A, 16B and 16C is configured to detect ACTIVE signals from the other ones of light sources 16A, 16B and 16C. At different times, each of light sources 16A, 16B and 16C listens for ACTIVE signals from the other light sources. If the light source detects an ACTIVE signal from another one of the light sources then it disables its associated holding current circuit 19 and stops sending ACTIVE signals.

The first light source to listen for ACTIVE signals will detect the ACTIVE signals being issued by one or more of the other light sources and will disable its holding current circuit and stop sending ACTIVE signals. This will occur for each light source. Finally, the last light source to listen for ACTIVE signals from other light sources will not detect ACTIVE signals in block 46 because all of the other light sources will have previously stopped transmitting ACTIVE signals. That light source will therefore execute block 51. Execution of block 51 may disable transmission of the ACTIVE signal which is no longer required since all of the other light sources will have previously disabled their holding current circuits.

FIG. 5 shows an optional additional listening period in block 46A. In an example embodiment, blocks 46A and 48A are executed only if no ACTIVE signals were detected in block 46. Block 46A may be executed at a random time after block 46. Listening period 46A provides a safety round. Block 48A branches depending upon whether or not an ACTIVE signal from another light source was detected in the listening period of block 46A. This avoids the possibility that one light source will fail to detect an ACTIVE signal from another because both light sources are listening for ACTIVE signals from the other at the same time.

When one of the light sources (e.g. a light source 16 as shown in FIG. 2) fails to detect an ACTIVE signal in both of blocks 46 and 46A then it can infer that it is the last light source with an active holding current circuit and can terminate method 40 leaving the holding current circuit enabled. Where blocks 46 and 46A are both set to occur at random times it is very unlikely that both of blocks 46 and 46A will occur at the same time as other light sources are also listening for ACTIVE signals.

By selecting listening periods 46, 46A that are appropriately long relative to the spacing of ACTIVE signals method 40 may be made so as to reliably leave only one holding circuit active among a plurality of light sources and to terminate (thereby avoiding further expenditures of energy associated with transmitting ACTIVE signals, processing and other aspects of performing method 40).

In embodiments in which optional blocks 46A and 48A are not included, processing may proceed as indicated by branch 49.

Figure 5A:
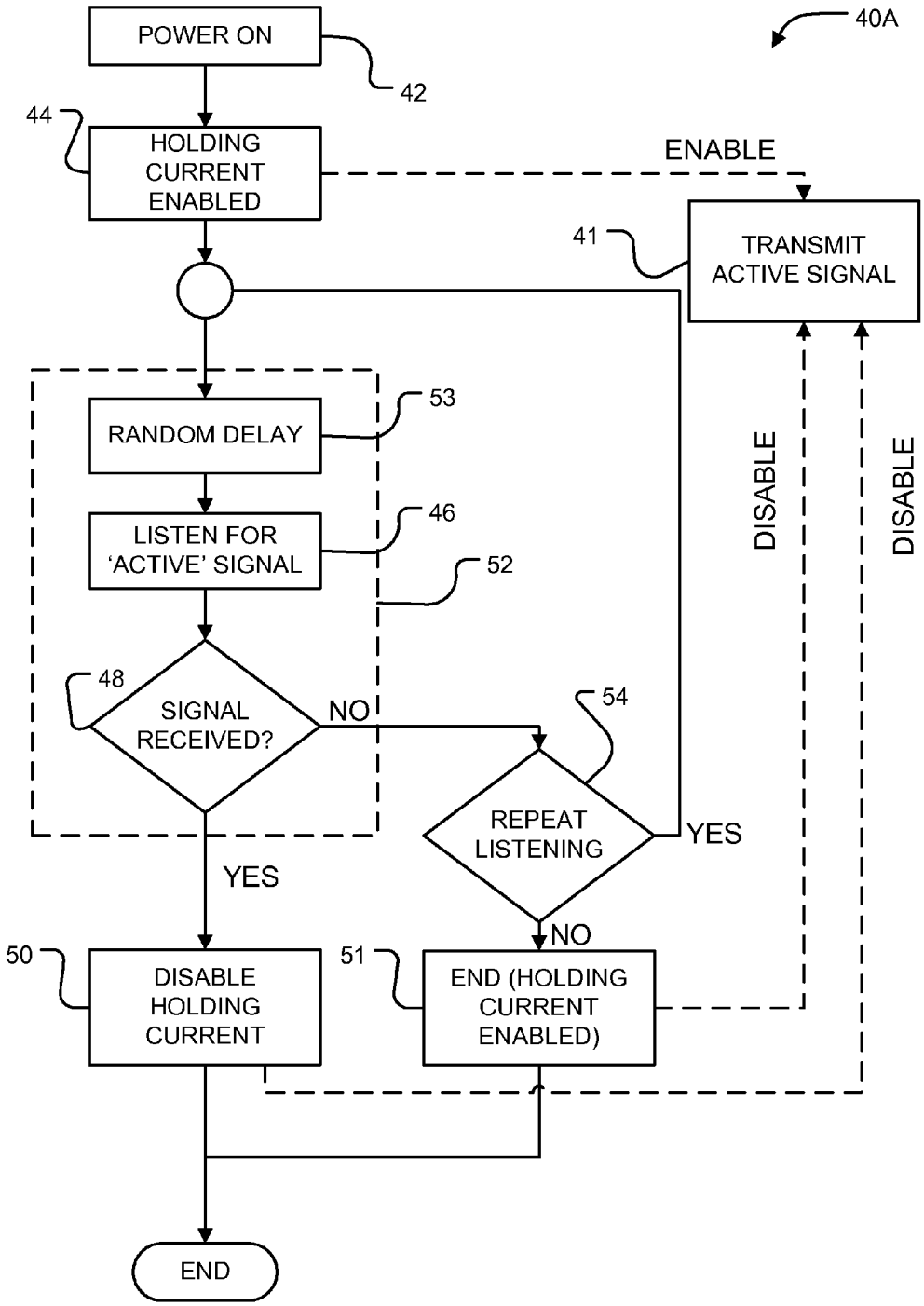

FIG. 5A illustrates a method 40A according to one particular example implementation. Blocks in FIG. 5A are labeled with the same reference numbers as in FIG. 5. In method 40A listening block 46 and decision block 48 are provided in a routine 52 that can be executed by a processor. A random time delay is explicitly included as block 53 in routine 52. If routine 52 detects an ACTIVE signal from another light source (YES branch from block 48) in listening block 46 then the holding current circuit is disabled, the transmission of ACTIVE signals is disabled and method 40A ends. Otherwise, block 54 determines whether listening routine 52 should be repeated. Block 54 may, for example, include a counter that causes listening routine 52 to be executed some number of times (as long as no ACTIVE signal is detected), for example.

Optionally, after block 50 has been executed method 40 (of FIG. 5) or method 40A (of FIG. 5A) may periodically monitor a characteristic of the incoming power that is indicative of whether or not adequate holding current is being drawn. If the characteristic indicates that adequate holding current is not being drawn then the method may enable the holding current circuit and restart method 40.

Optionally method 40 (or 40A) disables the holding current in block 50 only after ACTIVE signals from other light sources have been received twice. This avoids the possibility that the last light source with an active holding current circuit could disable its holding current circuit e.g. as a result of detecting noise that appears to be an ACTIVE signal from another light source but is not.

In embodiments in which the power line is used to carry "ACTIVE" signals, then any suitable protocol may be used. In some embodiments, for example, a light source includes a circuit that imposes periodic high frequency spikes or other characteristic signals on the power line to indicate that a holding current circuit is active in the light source. As all of the light sources are connected to the same power line, each of the light sources is able to receive the ACTIVE signals imposed on the power line by other light sources. If necessary, a filter may be connected to prevent the ACTIVE signals imposed on the power line from propagating back through a dimmer (such as dimmer 14 of FIG. 2) into circuits containing other light sources.

Figure 6:
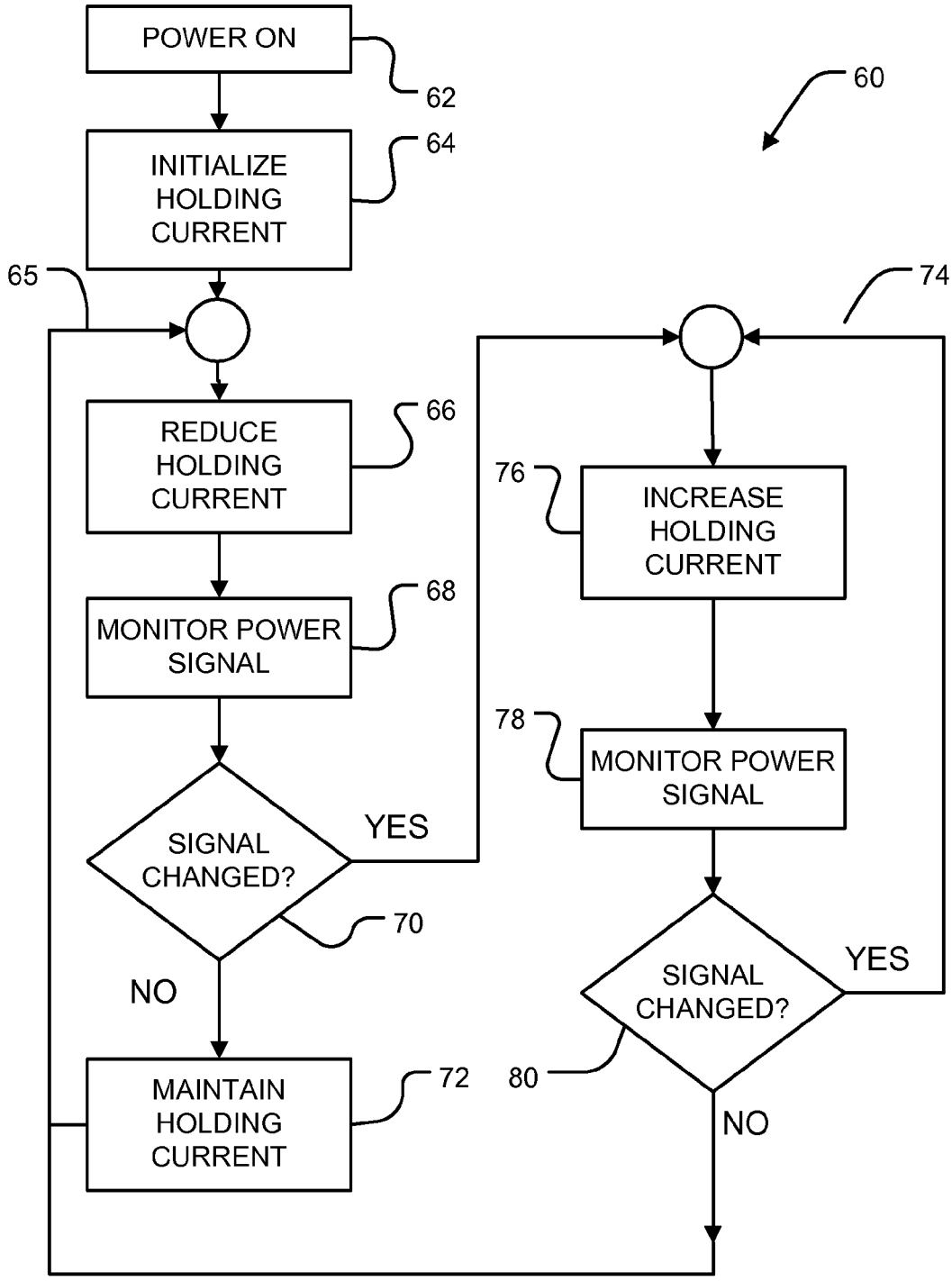
FIG. 6 is a flowchart illustrating a method for controlling holding current according to another example embodiment.

As mentioned above, it is not mandatory that each individual holding current circuit be either enabled to draw the full holding current required by dimmer 14 or disabled entirely. FIG. 6 illustrates one method 60 in which the current drawn by a holding current unit in a light source may be adjusted up or down over time to maintain an overall reduced draw of current. Where method 60 is performed separately in multiple light sources, the result can be that the holding current required by dimmer 14 is maintained by sharing among holding current units in multiple different light sources all connected to be driven by the same dimmer 14.

When power is applied to a circuit as indicated at block 62, a holding current circuit in each of the connected light sources is initialized at block 64. At block 66 the current being drawn by the holding current circuit is reduced by a small amount. The amount by which the current is reduced in block 66 may be always the same or may differ. In block 68, a power signal is monitored for signs that the collective current being drawn by the light sources driven by a dimmer 14 is less than the required holding current.

Figure 7A:
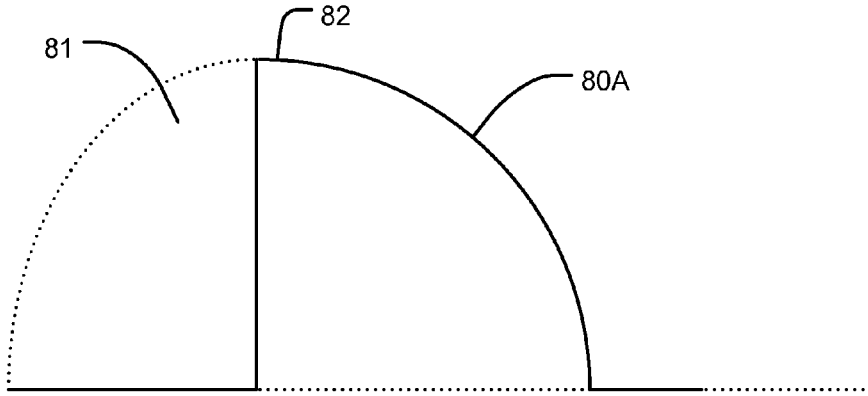
FIGS. 7A and 7B respectively illustrate example waveforms provided by a dimmer in the case where adequate holding current is maintained and the case where the current draw is allowed to fall below the holding current required by the dimmer.
Figure 7B:
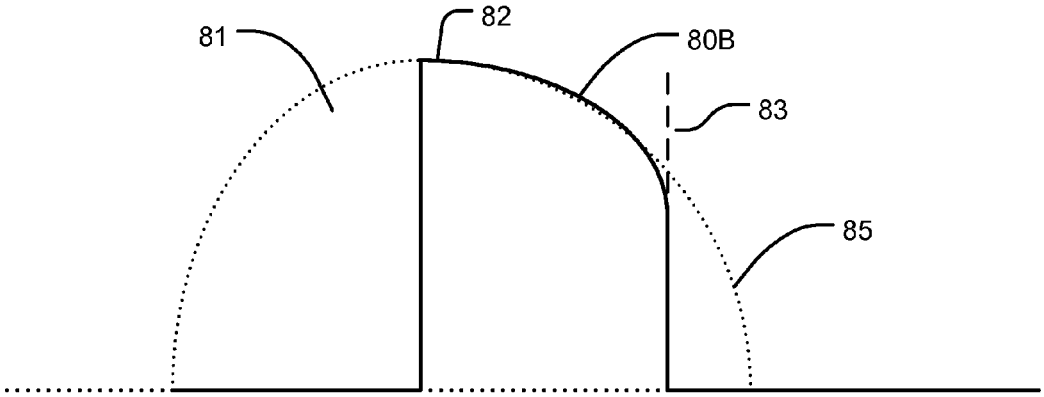

For example, FIGS. 7A and 7B illustrate a possible effect of insufficient current draw. FIG. 7A illustrates one positive half-cycle for a waveform 80A supplied by dimmer 14 for the case where the current being drawn is sufficient for proper operation of a dimmer (exceeds the holding current required by the dimmer). The negative half-cycle would be similar in appearance but reflected about the horizontal axis. Waveform 80A is a sinusoidal waveform except that operation of a phase cut dimmer has made a cut 81 in the leading edge of each peak 82. Except for cut 81 in each half-wave, waveform 80A is essentially a complete sinusoid.

FIG. 7B shows a contrasting waveform 80B in which current being drawn is insufficient for proper operation of the dimmer (the current drops below the holding current in at least part of the cycle). As a result, the current drawn from the dimmer fell below the dimmer's holding current at point 83 resulting in the dimmer shutting off prematurely and the trailing edges 85 of the peaks of waveform 80B being cut off.

It can be seen that waveforms 80A (of FIG. 7A) and 80B (of FIG. 7B) differ in various characteristics such as: the width of peaks 82, the average voltage over a cycle or half-cycle, the time after the leading edge of each peak that the waveform falls below a threshold value etc. Any one or more of these characteristics may be monitored and used as an indication of whether or not adequate current is being drawn to keep the dimmer operating properly. One way to obtain a binary signal indicating whether or not adequate current is being drawn for a particular setting of a holding current circuit is to compare a waveform characteristic being monitored (for example average voltage over a cycle) for a case where it is known that adequate current is being drawn with the same waveform characteristic determined for the particular setting of the holding current circuit. If the characteristic is the same in both cases then it can be inferred that the particular setting results in adequate current being drawn. Otherwise it can be inferred that the particular setting results in inadequate current being drawn by the holding current circuits to maintain a current at the dimmer at least equal to the holding current.

Referring again to FIG. 6, if the signal did not change ("NO" branch from block 70) then the reduced current is maintained in block 72 and control returns to block 66 which again reduces the current drawn by the holding current circuit by a small amount. Since, upon initialization, the current being drawn in aggregate by all of the light sources connected to a particular circuit will likely be significantly greater than the required holding current, each light source will likely iterate loop 65 multiple times, reducing the amount of current drawn by its holding current circuit in each iteration of loop 65.

At some point, the collective current being drawn by all of the light sources on the circuit will be just adequate to maintain the current drawn from dimmer 14 at least equal to the required holding current (the amount of holding current for one dimmer 14 may be different from that which might be required by other dimmers).

A further reduction in current drawn by the holding current circuit in any one of the light sources will result in a change in the signal monitored at block 68 ("YES" branch from block 70). In this event, control passes to loop 74 which increases the current drawn by the holding current circuit at block 76. The power signal is again monitored at block 78. If the signal changed ("YES" branch from block 80) then this indicates that at least one further small increase in current drawn by the holding current circuit should be provided to ensure that an adequate aggregate current is being drawn.

If the monitoring in block 78 did not detect any change in the signal resulting from the increase in current then this indicates that sufficient current was being drawn prior to the increase in block 76 and control passes back to loop 65. Loops 65 and 74 may be performed at a rate of once every few minutes, for example. In some embodiments, loops 65 and 74 are performed more rapidly when power is first turned on and then more slowly after a while. This permits the minimum current required for proper operation of dimmer 14 to be established soon after power is applied.

Monitoring in block 68 and 78 may be performed, for example, for a sufficient period to detect whether or not a sufficient holding current is being drawn. Typically, these periods may have a duration of approximately four half cycles of the AC waveform being provided (for example, approximately 33 milliseconds).

In some embodiments, light sources have a non-volatile memory which preserves the setting of the holding current circuit and block 64 comprises setting the holding current to the preserved setting.

Method 40 (of FIG. 5) or 60 (of FIG. 6), or variations of those methods, may be executed by means of suitably configured hardware circuits or a programmed processor for executing suitable software or firmware instructions connected to control the hardware of a light source.

Figure 8:
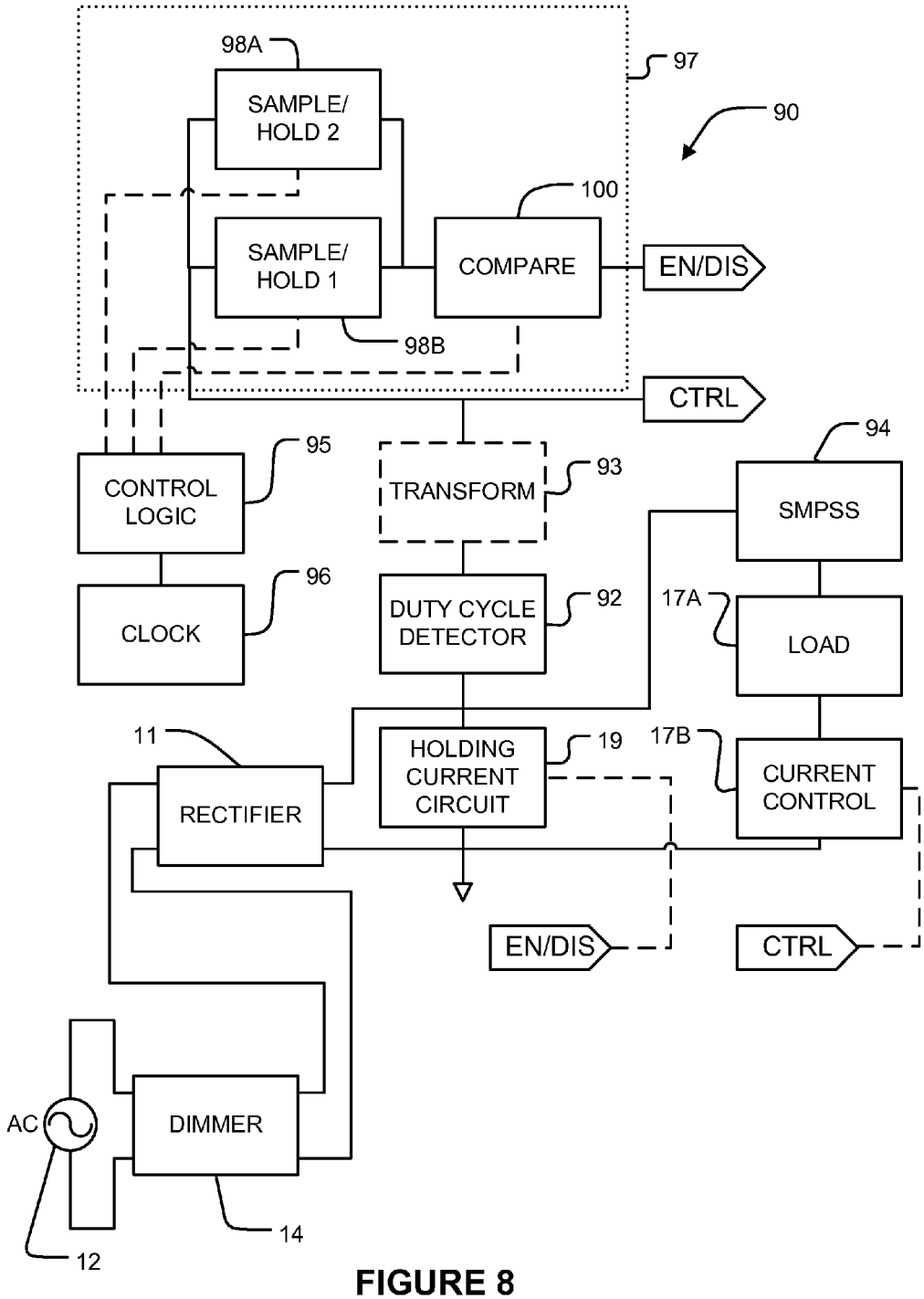
FIG. 8 is a block diagram illustrating apparatus according to another example embodiment.

FIG. 8 shows apparatus 90 according to another example embodiment. Apparatus 90 comprises a duty cycle detector 92 and optionally a non-linear transformer (for example, an exponential amplifier) 93 that produces a control signal CTRL. CTRL is applied to current control 17B that controls current through light source 17A. In the illustrated embodiment a switching mode power supply (SMPS) 94 provides appropriate electrical power to light source 17A.

Apparatus 90 comprises control logic 95 driven by a clock 96 that controls a system 97 for enabling or disabling holding current circuit 19. System 97 comprises first and second sample and hold circuits 98A and 98B and a comparison unit 100. Control logic 95 has four stages. In a first stage, control logic 95 resets system 97. In a second stage, control logic 95 controls first sample and hold circuit 98A to sample CTRL over a first period of time during which holding current circuit 19 is disabled. The first period of time may, for example, comprise one cycle or ½ cycle of AC power from dimmer 14. After the first period, the output of first sample and hold circuit 98A is a signal representing the average of the CTRL signal over the first period.

In the third stage, control logic 95 controls second sample and hold circuit 98B to sample CTRL over a second period of time during which holding current circuit 19 is enabled. After the second period, the output of second sample and hold circuit 98B is a signal representing the average of the CTRL signal over the second period.

In the fourth stage, control logic 95 controls comparison unit 100 to compare the signals at the outputs of the first and second sample and hold circuits 98A and 98B. After the fourth stage the output of comparison unit 100 is a signal EN/DIS that indicates whether the signals at the outputs of the first and second sample and hold circuits 98A and 98B are the same or different. A difference indicates that the holding current circuit 19 makes a difference (and is therefore required to draw current for proper operation of the dimmer). No difference indicates that holding current circuit 19 is not required to draw current. EN/DIS is applied to control holding current circuit 19. Control logic 95 periodically repeats the operations described above and enables or disables holding current circuit 19 as required.

As an alternative to enabling or disabling holding current circuit 19, the output of comparison unit 100 may be applied to a circuit that controls the maximum current that will be drawn by the holding current circuit 19 (i.e. that controls an upper limiting current for the holding current circuit 19). In such embodiments the second and third stages may compare two different settings for holding current circuit 19. For example, in such embodiments, the second and third stages may compare an active setting for the holding current circuit to a proposed setting in which the maximum current drawn by the holding current circuit is increased or decreased relative to the active setting.

If the active setting is known to result in adequate current draw then, where the output of comparison unit 100 indicates that the signals at the outputs of the first and second sample and hold circuits 98A and 98B are the same (meaning that the increase or decrease makes no difference) then the apparatus may be configured to make the active setting be the one of the compared settings drawing the least amount of current. On the other hand, if the output of comparison unit 100 indicates that the signals at the outputs of the first and second sample and hold circuits 98A and 98B are different then the apparatus may be configured to make the active setting be the one of the compared settings drawing the greater amount of current.

In some embodiments, holding current circuits in each of a plurality of light sources are configured to maintain a draw of at least a portion of the holding current required by a dimmer. Light sources as shown in FIG. 2 may be constructed and/or configured to perform in this manner for example. For example, where a dimmer 14 is connected to power N dimmable light sources then a holding current circuit associated with each of the light sources may be configured such that the light source always draws at least a current of 1/N of the holding current required. In some embodiments, the portion of the holding current maintained by each of holding current circuits is configurable. For example, holding current circuits 19 may comprise interfaces (e.g., physical interfaces such as switches, or the like, or electronic or electrical interfaces for receiving signals) for specifying the portion of a holding current each circuit is to maintain (e.g., a switch may be set or a signal may be provided to specify that a number N of holding current circuits are on a dimming circuit, and the holding current circuit associated with the switch is configured to automatically maintain a current drawn by the light source of at least 1/N of the required holding current).

In some embodiments, light sources 16 comprise holding current circuits 19 and an interface for selectively enabling or disabling the holding current circuit 19. The interface may comprise, for example, a manually operable switch, jumper, or electronic or electrical interfaces for receiving signals. Where a plurality of such light sources are all connected to a circuit controlled by the same dimmer, a person installing the light sources may manually configure the light sources such that holding current circuits are disabled in all but one of the light sources or all but some of the light sources.

Figure 9:
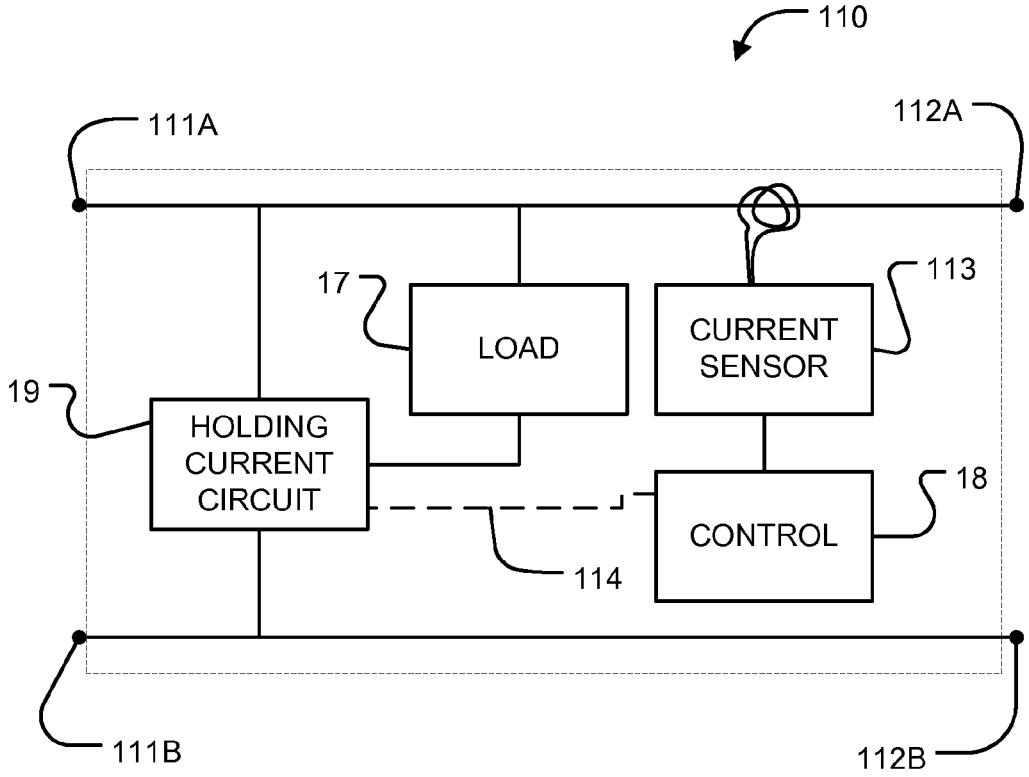
FIG. 9 is a block diagram illustrating a light source according to a further alternative embodiment.

FIG. 9 illustrates a further alternative embodiment. Light sources 110 as shown in FIG. 9 may be daisy chained together. Each light source 110 has contacts 111A and 111B for connecting to power from a dimmer and contacts 112A and 112B for connecting to another light source. Contacts 111A and 112A are connected and contacts 111B and 112B are connected. Thus current can pass through one light source 110 to other light sources 110 downstream. The light sources themselves are electrically in parallel with one another.

A current sensor 113 monitors current to any downstream light sources connected to contacts 112A and 112B. A signal from current sensor 113 is monitored by a control circuit 114. No current corresponds to no downstream light sources 110. In one possible mode of operation, controller inhibits operation of holding current circuit 19 as long as current sensor 113 detects current being supplied to one or more downstream light sources 110. Thus, the holding current circuit 19 in the light source 110 at the end of a chain will be enabled while the holding circuits 19 in light sources 110 that are upstream will be inhibited.

As a further, or alternative, energy saving strategy, light sources according to some embodiments include a phase angle detector which can be turned on or off and a control which can use information received from a source outside of the light source in place of a signal from the phase angle detector when the phase angle detector is turned off. For example, FIG. 4A shows a phase angle detector 28 which can be turned on or off by a control signal 34 from control 18. Some phase angle detector circuits consume a small amount of power in operation. Since the phase angle will be the same for all light sources 27 connected to the same dimmer (e.g. a dimmer 14 as shown in FIG. 4), it is only necessary to perform phase angle detection once. Information about the detected phase angle may be shared with other units 27 by way of a data received at interface 29. In some embodiments, control 18 may be configured to keep phase angle detector 28 inoperative (and consuming all or reduced power) as long as phase angle information from a source external to the light source is being received at interface 29.

In some embodiments light sources as described herein are packaged to have a form factor similar to that of a standard incandescent or CCFL bulb with a base suitable for connection to a standard receptacle. Such light sources may be installed as a direct replacement for incandescent, CCFL or other less energy-efficient light sources.

It is not mandatory to use a phase angle detector to obtain a signal to be used for controlling light sources as described herein. Other measurements may be used to determine a desired dimming level. For example any of phase angle, average voltage or other suitable characteristic may be monitored to ascertain a desired dimming level.

While a number of exemplary aspects and embodiments have been discussed above, those of skill in the art will recognize certain modifications, permutations, additions and sub-combinations thereof. It is therefore intended that the following appended claims and claims hereafter introduced are interpreted to include all such modifications, permutations, additions and sub-combinations as are within their true spirit and scope.

What is claimed is:

1. A lighting system comprising:

a dimmer that requires at least a holding current to be drawn for proper operation;

a plurality of solid state light sources connected in parallel to an output of the dimmer, each of the solid state light sources comprising:

a light emitter;

a holding current circuit operable to draw a current from the dimmer; and a control circuit connected to selectively control the current drawn by the holding current circuit; and a control system configured to automatically reduce an excess of the sum of the currents drawn by the holding current circuits over the holding current wherein the control system comprises a path by way of which the control circuits of the solid state light sources are configured to exchange information and the control circuits are configured to disable the corresponding holding current circuits or reduce the current drawn by the corresponding holding current circuit in response to information received from other ones of the control circuits.

2. The lighting system according to claim 1 wherein the control system comprises a separate controller in data communication with the solid state light sources and the separate controller is configured to command one or more of the solid state light sources to disable its holding current circuit or to reduce the current drawn by its holding current circuit.

3. The lighting system according to claim 1 wherein the solid state light source control circuits are configured to disable the corresponding holding current circuits upon receipt of a signal indicating that a holding current circuit of another solid state light source is drawing a holding current.

4. The lighting system according to claim 3 wherein the path comprises a power line connected to supply power from the dimmer to the solid state light sources and the solid state light sources comprise circuits for transmitting and receiving ACTIVE signals comprising signals higher in frequency than a powerline frequency.

5. The lighting system according to claim 3 wherein the control circuit in each of the solid state light sources is configured to control a signal transmitter to periodically transmit ACTIVE signals receivable by other solid state light sources when the holding current circuit is enabled and wherein the control circuit in each of the solid state light sources is configured to monitor for ACTIVE signals transmitted by other solid state light sources for a period of time and to maintain the holding current circuit enabled if no ACTIVE signals are detected in the period of time.

6. The lighting system according to claim 5 wherein the periods of time for different ones of the solid state light sources commence at different times.

7. The lighting system according to claim 5 wherein the control circuit in each of the solid state light sources is configured to monitor for ACTIVE signals transmitted by other solid state light sources for a first period of time and for a second period of time commencing after the end of the first period of time, to disable the corresponding holding current circuit if an ACTIVE signal is detected in the first or second period of time, and to maintain the holding current circuit enabled if no ACTIVE signals are detected in the first or second periods of time.

8. The lighting system according to claim 1 wherein the control circuit is configured and connected to selectively control a maximum current drawn by the holding current circuit.

9. The lighting system according to claim 1 wherein each of the solid state light sources comprises a monitoring circuit connected to detect a characteristic of electrical power from the dimmer that can change in response to a total current being drawn from the dimmer falling below the holding current and the monitoring circuit is connected to enable and disable the corresponding holding current circuit and comprises a comparison circuit configured to compare the characteristic as measured with the holding current circuit enabled to the characteristic as measured with the holding current circuit disabled.

10. The lighting system according to claim 9 wherein the comparison circuit comprises first and second sample and hold circuits and control logic that in a first stage disables the holding current and operates the first sample and hold circuit to obtain a first measure of the characteristic with the holding current circuit disabled and in a second stage before or after the first stage enables the holding current and operates the second sample and hold circuit to obtain a second measure of the characteristic with the holding current circuit enabled.

11. The lighting system according to claim 9 wherein the control circuit is configured to reduce the current drawn by the holding current circuit in response to an output of the monitoring circuit indicating a total current being drawn from the dimmer is not falling below the holding current and wherein the control circuit is configured to increase the current drawn by the holding current circuit in response to an output of the monitoring circuit indicating a total current being drawn from the dimmer is falling below the holding current.

12. The lighting system according to claim 1 wherein one or more of the solid state light sources comprises:

a power input connectable to receive electrical power from the dimmer;

a power output connectable to supply power to one or more additional solid state light sources;

an electrical conductor connected between the power input and the power output; and a current monitor connected to monitor an electrical current in the conductor;

wherein the control circuit of the one or more of the solid state light sources is configured to control the current drawn by the holding current circuit at least in part in response to a signal from the current monitor.

13. A solid state light source comprising:

a light emitter, a holding current circuit operable to draw a holding current, and a control circuit connected to selectively enable or disable the holding current circuit or to selectively control a value for the upper limiting current that the holding current circuit is configured to draw wherein the solid state light source comprises a signal input for receiving signals and the control circuit is configured to disable the holding current circuit upon receipt of a signal indicating that another solid state light source is drawing a holding current.

14. The solid state light source according to claim 13 comprising a signal transmitter operable to periodically transmit ACTIVE signals receivable by other solid state light sources when the holding current circuit is enabled wherein the control circuit is configured to monitor for ACTIVE signals transmitted by other solid state light sources for a period of time and to maintain the holding current circuit enabled if no ACTIVE signals are detected in the period of time.

15. A solid state light source comprising:

a light emitter, a holding current circuit operable to draw a holding current, and a control circuit connected to selectively enable or disable the holding current circuit or to selectively control a value for the upper limiting current that the holding current circuit is configured to draw wherein the holding current circuit comprises a variable attenuator connected in series in a holding current path and the control circuit is configured to set an impedance of the variable attenuator.

16. The solid state light source according to claim 15 wherein the holding current circuit is configured to provide a holding current having a magnitude up to a maximum holding current and the maximum holding current is selectively variable.

* * * * *